US006607409B2

(12) United States Patent
Machado

(10) Patent No.: US 6,607,409 B2
(45) Date of Patent: Aug. 19, 2003

(54) CONNECTOR TERMINAL WITH RESILIENT CONTACTS

(75) Inventor: Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 10/242,075

(22) Filed: Sep. 11, 2002

(65) Prior Publication Data

US 2003/0013352 A1 Jan. 16, 2003

Related U.S. Application Data

(63) Continuation of application No. 09/651,151, filed on Aug. 30, 2000, now Pat. No. 6,520,812.

(51) Int. Cl.[7] ..... H01R 11/22; H01R 13/11

(52) U.S. Cl. ..... 439/855

(58) Field of Search ..... 439/855, 860, 439/868, 859, 225

(56) References Cited

U.S. PATENT DOCUMENTS

| | | | |
|---|---|---|---|
| 1,213,632 | A | 1/1917 | Hammond |
| 1,225,125 | A | 5/1917 | Guett |
| 1,579,008 | A | 3/1926 | Lake, Jr. |
| 1,707,933 | A | 4/1929 | Gibbons |
| 1,874,593 | A | 8/1932 | Olson |
| 1,967,091 | A | 7/1934 | Kempton |
| 2,399,957 | A | 5/1946 | Tinnerman |
| 2,404,176 | A | 7/1946 | Huelster |
| 2,874,254 | A | 2/1959 | Daily et al. |
| 2,944,330 | A | 7/1960 | Swick |
| 3,221,094 | A | 11/1965 | Cherry |
| 3,569,919 | A | 3/1971 | Daddona, Jr. |
| 3,777,301 | A | 12/1973 | Michaels |
| 3,812,452 | A | 5/1974 | Sturm |
| 3,850,500 | A | 11/1974 | Cobaugh et al. |
| 3,857,349 | A | 12/1974 | Pritulsky |
| 3,858,151 | A | 12/1974 | Paskert |
| 3,862,792 | A | 1/1975 | Jayne |
| 3,980,388 | A | 9/1976 | Nailor, III |
| 4,056,299 | A | 11/1977 | Paige |
| 4,085,989 | A | 4/1978 | McCardell |
| 4,410,228 | A | 10/1983 | Stephenson |
| 4,683,390 | A | 7/1987 | Imori et al. |
| 4,734,064 | A | 3/1988 | Knapp et al. |
| 4,775,339 | A | 10/1988 | Sasaki et al. |
| 4,802,870 | A | 2/1989 | Lee |
| 4,832,629 | A | 5/1989 | Sasaki et al. |
| 4,943,247 | A | 7/1990 | Wise |
| 4,950,186 | A | 8/1990 | Kaley et al. |
| 4,983,133 | A | 1/1991 | Van Scyoc et al. |
| 5,108,320 | A | 4/1992 | Kimber |
| 5,162,003 | A | 11/1992 | Johnson et al. |
| 5,174,768 | A | 12/1992 | Hewison et al. |
| 5,206,796 | A | 4/1993 | Thompson et al. |
| 5,413,500 | A | 5/1995 | Tanaka |
| 5,707,243 | A | 1/1998 | Endo et al. |
| 5,713,767 | A | 2/1998 | Hanson et al. |
| 5,735,716 | A | 4/1998 | Bilezikjian |
| 5,749,740 | A | 5/1998 | Swift et al. |
| 5,833,500 | A | 11/1998 | Mahon et al. |
| 5,863,227 | A | 1/1999 | Bell, Jr. |
| 5,957,738 | A | 9/1999 | Schryer |
| 5,980,338 | A | 11/1999 | Le Pottier et al. |
| 5,993,256 | A | 11/1999 | Shimojyo |
| 5,997,341 | A | 12/1999 | Ushiyama et al. |
| 6,027,382 | A | 2/2000 | Reindl et al. |

*Primary Examiner*—Javaid H. Nasri
(74) *Attorney, Agent, or Firm*—Hamilton, Brook, Smith & Reynolds, P.C.

(57) ABSTRACT

A connector terminal has a base with an opening extending therethrough. The opening is surrounded by an inner border of the base. A series of resilient contacts extend away from the base from the inner border to form a socket. The contacts have opposed surfaces which are spaced apart from each other and positioned to define the socket. The contacts have tips that extend in an outwardly direction relative to the opening to allow easy insertion into and removal of a male terminal from the socket. A securement portion on the base allows a conductor to be secured to the connector terminal.

33 Claims, 6 Drawing Sheets

CONNECTOR TERMINAL WITH RESILIENT CONTACTS

RELATED APPLICATION

This application is a continuation of U.S. application Ser. No. 09/651,151, filed Aug. 30, 2000, now U.S. Pat. No. 6,520,812. The entire teachings of the above application are incorporated herein by reference.

BACKGROUND

Devices such as antennas are often formed on or within the front or rear windows of an automotive vehicle. In order to electronically connect the antenna to an associated device (such as a radio or telephone), an electrical terminal, usually a male terminal, is soldered to the glass in communication with the antenna. A female terminal which is at the end of a cable connected to the associated device is then mated with the male terminal located on the glass.

In some applications, the male terminal has a male circular post and the mating female terminal may have a cup shaped female socket having four resilient contact tabs for engaging the circular post. The contact tabs are bent inwardly into the socket for resilient engagement. The cup shaped socket of the female terminal is usually staked or riveted to a base piece which in turn is crimped to a conductor within the cable and housed within an insulative cover. Such a female socket is often used for low power applications such as antennas but is not suitable for devices such as rear window defrosters which require higher power.

SUMMARY

The present invention provides a female connector terminal which is suitable for both low power and high power applications. The present invention connector terminal includes a base with an opening extending therethrough. The opening is surrounded by an inner border of the base. A series of resilient contacts extend away from the base from the inner border to form a socket. The contacts have opposed surfaces which are spaced apart from each other and positioned to define the socket. The contacts have tips that extend in an outwardly direction relative to the opening to allow easy insertion into and removal of a male terminal from the socket. A securement portion on the base allows a conductor to be secured to the connector terminal.

In preferred embodiments, the base of the connector terminal is formed from sheet metal. The socket includes opposed pairs of contacts and has at least four contacts, with eight being more preferable. The socket is generally circular in shape and has an axis which is perpendicular relative to the base. The contacts are equidistantly positioned about the axis and evenly spaced apart from each other. The contacts are curved outwardly with a constant radius. The securement portion includes crimping tabs extending from the base for crimping to the conductor. A polymeric cover houses the base and has a socket opening for providing access to the socket. In one embodiment, the cover has an internal region with an internal groove for capturing the base. The base includes a protruding member for engaging a recess in the cover for locking the base within the cover. In another embodiment, the cover is molded over the base.

By integrally forming the socket of the present invention connector terminal with the base, staking or riveting of a socket to a base is not required. This makes the manufacturing process of the present invention easier and simpler than that of current terminals having cup shaped female sockets. In addition, inventory issues are simplified since parts for assembly do not need to be stored. Furthermore, the design of the present invention terminal permits use for high power applications.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
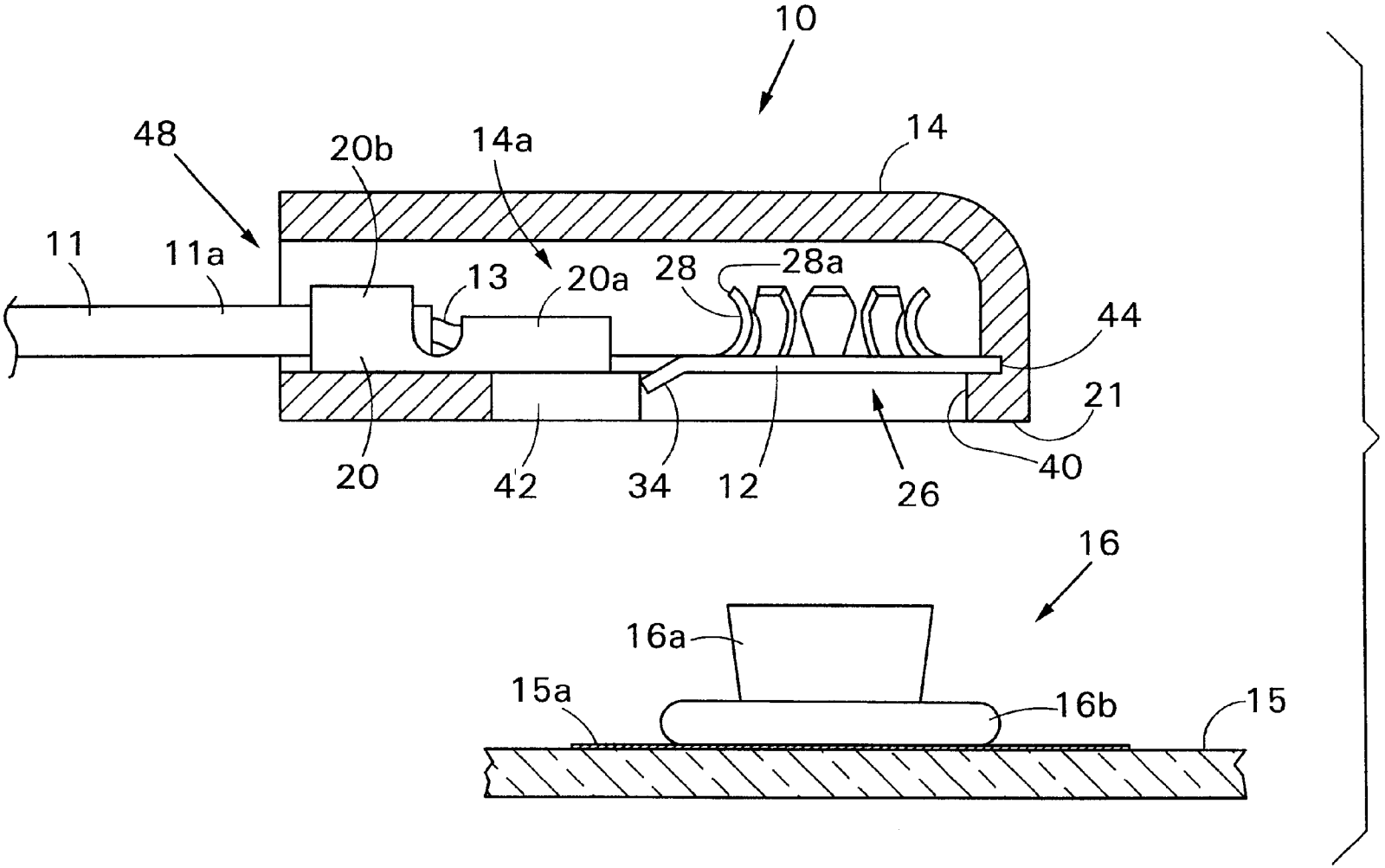
FIG. 1 is a side sectional view of an embodiment of the present invention connector terminal positioned above a mating circular male connector for engagement therewith.

A description of preferred embodiments of the invention follows. Referring to FIG. 1, female connector terminal 10 includes a circular female socket 26 for engaging the circular post 16*a* of a circular male connector 16 to provide electrical communication therebetween. Typically, the male connector 16 has a base 16*b* that is soldered to a metallic contact 15*a*, for example, on the rear window or windshield 15 of an automotive vehicle. The contact 15*a* is in electrical communication with an electrical device formed on or within the glass such as an antenna or window defroster. Male connector 16 may be similar to that described in U.S. Pat. No. 6,039,616, the contents of which are incorporated herein by reference in its entirety. The female connector terminal 10 is located at the end of a cable 11 which is electrically connected to equipment associated with the electrical device, such as a radio, a telephone, or window defroster controls. Connector terminal 10 includes a sheet metal insert 12 (FIGS. 2 and 3) having a series of outwardly curved resilient contacts 28 which form the female socket 26. Insert 12 is crimped to cable 11 and is housed and protected by a polymeric cover 14. A circular opening 40 in the bottom 21 of the cover 14 provides access for male connector 16 to engage socket 26.

Figure 2:
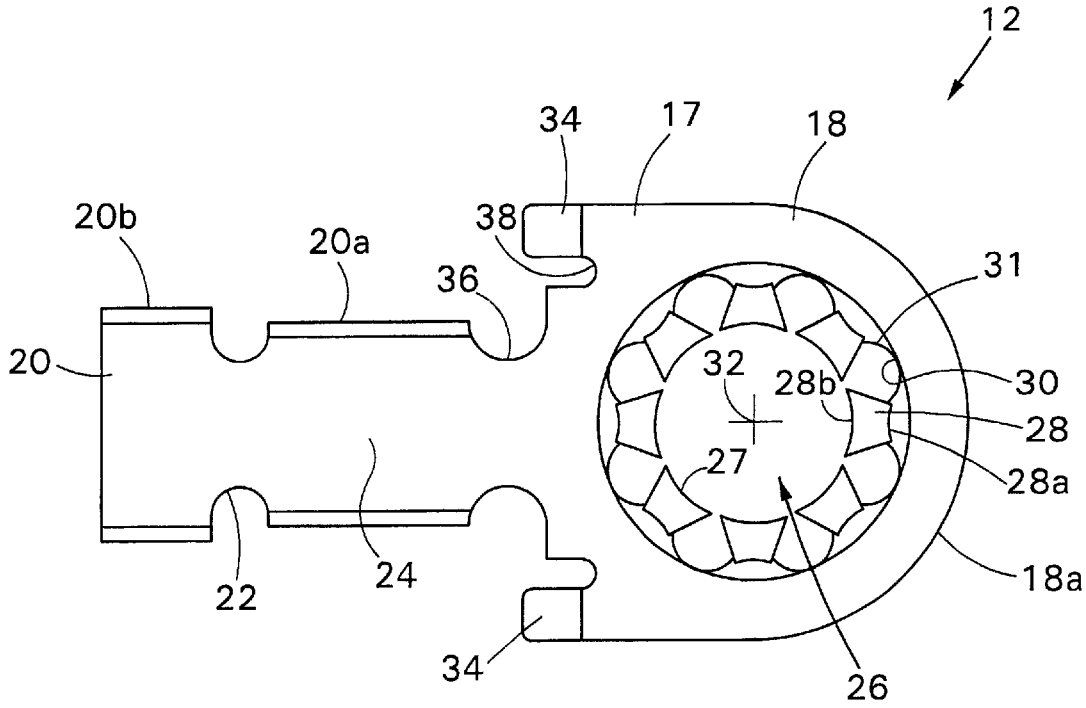
FIG. 2 is a top view of the insert for the connector terminal shown in FIG. 1.
Figure 3:
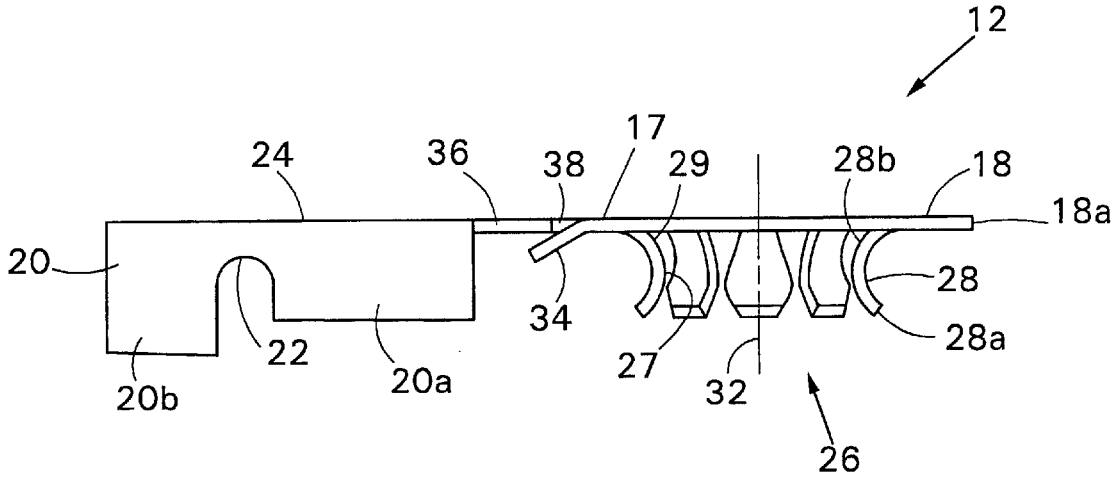
FIG. 3 is a side view of the insert.

Referring to FIGS. 2 and 3, insert 12 has a generally planar base 17 having a socket portion 18 containing socket 26, and a securement or crimping portion 20. The socket portion 18 has a curved generally circular end 18*a* and an opening 31 extending through the central part of socket portion 18. The series of contacts 28 which form socket 26 are bent from the inner border of the base 17 surrounding opening 31 and extend away from the base 17. As a result, socket 26 is substantially offset relative to the plane of base 17. The contacts 28 are arranged in a generally circular pattern and are equally spaced apart from each other. The tips 28*a* of contacts 28 curve outwardly relative to the opening 31. The securement portion 20 has an elongate planar portion 24 extending from socket portion 18. Two pairs of crimping tabs 20*a* and 20*b* extend from opposite sides of portion 24 for crimping to the conductor 13 and insulation 11*a* of cable 11 for securement thereto. After being crimped to cable 11, insert 12 may be pushed into the interior cavity 14*a* of cover 14 through rear opening 48 (FIG. 1) wherein socket 26 is aligned with the opening 40 in the bottom 21 of cover 14.

In use, when connector 10 is engaged with circular male connector 16, the male connector 16 is inserted into socket 26 and resiliently deflects contacts 28 outwardly as the male connector 16 enters socket 26. The interior cavity 14*a* of cover 14 (FIG. 1) extends above socket 26 a sufficient distance so that the top of male connector 16 may extend past socket 26. The resilient contacts 28 press radially inwardly against the post 16*a* of male connector 16 with sufficient pressure to maintain electrical communication therebetween. Since the tips 28*a* of the contacts 28 curve outwardly, connector terminal 10 is easily insertable and removable from male connector 16 because the tips 28*a* of contacts 28 do not dig into the post 16*a* of male connector 16 when the contacts 28 slide relative to post 16*a*. The eight contacts 28 shown in FIGS. 2 and 3 provide sufficient contact surface area between the contacts 28 and the male connector 16 to provide power to higher power devices such as a rear window defroster. Connector 10 is also suitable for low power signal applications such as radio and telephone antennas.

A more detailed description of the present invention now follows. Insert 12 may be formed from a ribbon of sheet metal in a stamping and bending process by a forming die having a series of consecutive forming stations. The contacts 28 are equidistantly positioned apart from each other around central axis 32. As shown in FIG. 2, the contacts 28 are arranged in opposed pairs and form a generally circular socket 26. The opening 31 formed in the socket portion 18 of base 17 has a series of curved regions 30 positioned between the contacts 28 extending outwardly relative to the feet 29 of the contacts 28. The border of base 17 surrounding the opening 31 consists of the combination of the curved regions 30 and the inner surfaces 28*b* at the feet 29 of contacts 28. The contacts 28 curve inwardly toward central axis 32 from feet 29 before curving outwardly at the tips 28*a* (FIG. 3). The width of contacts 28 are narrower at the feet 29 and are angled to become wider at the contact regions 27 which contact male connector 16 for added surface area therebetween. The contact regions 27 are the areas of the contacts 28 (FIG. 3) which are located at the innermost point of the curve (closest to axis 32) on the inner surfaces 28*b*. The narrow feet 29 of contacts 28 allow contacts 28 to be more easily deflected than if the feet 29 were wider. This configuration provides contacts 28 with the ability to resiliently bend outwardly when engaged with male connector 16. The sides of contacts 28 are angled towards each other at the tips 28*a* which narrows the tips 28*a*. In addition to being longitudinally curved, the contacts 28 are also curved (FIG. 2) in the lateral direction relative to axis 32 at the contact regions 27 such that contact regions 27 form a series of curved surfaces that together circle and are generally concentric with axis 32. In other words, the curved surfaces of contact regions 27 form a generally circular perimeter for socket 26 about central axis 32. As a result, each contact 28 engages male connector 16 along a curved line of contact which provides increased surface contact with male connector 16.

The socket portion 18 includes locking members or tabs 34 (FIGS. 2 and 3) which are bent at an angle relative to socket portion 18. Tabs 34 are bent to be on the same side of base 17 as contacts 28. Tabs 34 engage recess 46 within cover 14 for locking insert 12 therein. Cutouts or recesses 38 on the end of socket portion 18 opposite to the circular end 18*a* define the inner edges of tabs 34. The socket portion 18 and securement portion 20 are in longitudinal alignment with the center of opening 31. The crimping tabs 20*a* and 20*b* of securement portion 20 are generally rectangular and separated from each other by cutouts or recesses 22. The lower crimping tabs 20*a* are crimped to the inner conductor 13 of cable 11 and the taller crimping tabs 20*b* are crimped to the outer insulation or covering 11*a* of cable 11. The lower crimping tabs 20*a* are separated from the socket portion 18 by cutouts or recesses 36. The width of securement portion 20 is sized for securing to particular cable sizes.

In one embodiment, insert 12 is formed from tempered copper 7025 that is 0.020 inches thick. In this embodiment, insert 12 is 0.491 inches wide and 0.937 inches long. Socket 26 has a minimum diameter of 0.195 inches ±0.003 defined by the inner surfaces 28*b* of contacts 28 along contact regions 27. The curved regions 30 of opening 31 are 0.072 inches in diameter positioned equally apart from each other on a 0.250 inch bolt hole pattern about central axis 32. Contacts 28 are curved outwardly with a 0.047 inch radius and have a height of 0.118 inches including the thickness of base 17. Tabs 34 are 0.061 inches wide and bent from base 17 about 0.04 inches. Crimping tabs 20*a* are 0.2 inches long in the longitudinal direction, and crimping tabs 20*b* are 0.12 inches long. The lateral distance between recesses 36 is about 0.14 inches.

Figure 4:
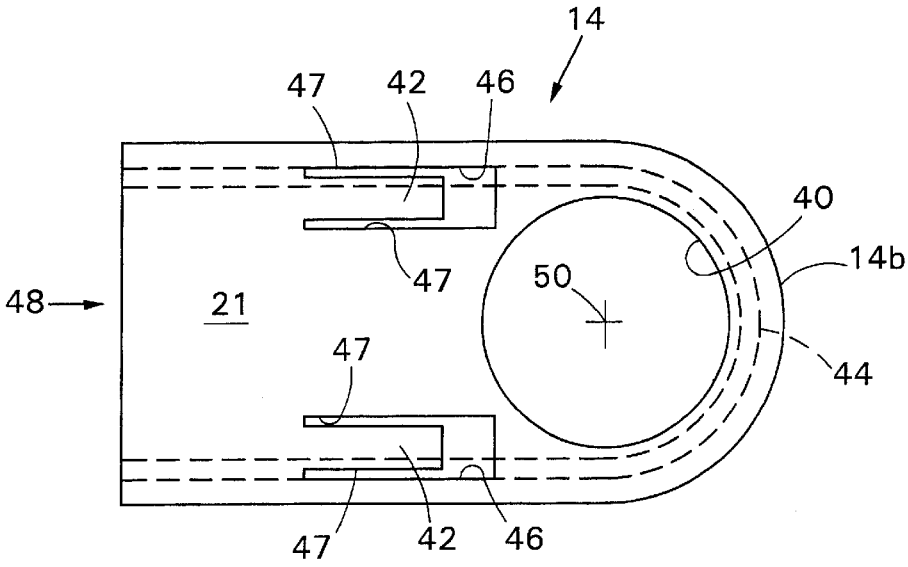
FIG. 4 is a bottom view of the cover for the connector terminal shown in FIG. 1.
Figure 5:
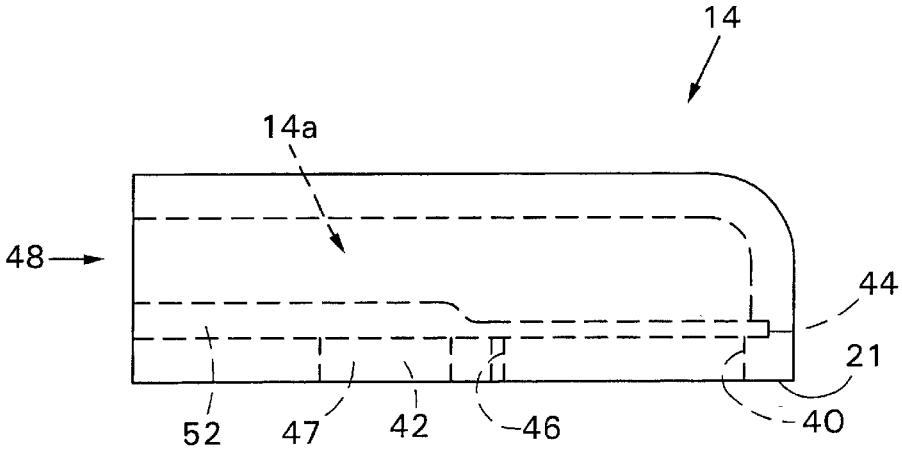
FIG. 5 is a side view of the cover.
Figure 6:
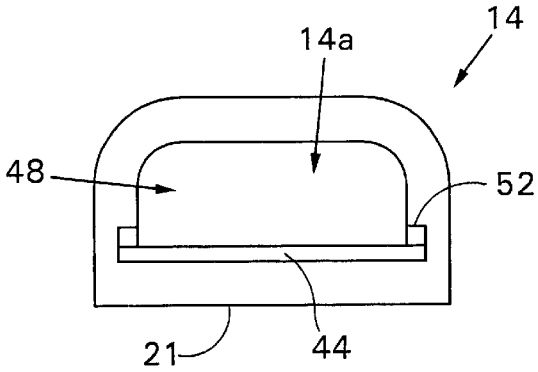
FIG. 6 is a rear view of the cover.

Referring to FIGS. 4–6, cover 14 has an elongate interior cavity 14*a* for housing insert 12. The rear portion of cover 14 has an opening 48 which allows insert 12 to be inserted into the interior cavity 14*a* along groove 44 and captured therein. Groove 44 has an enlarged entrance 52 which enables the bent tabs 34 of insert 12 to pass therethrough. Opening 40 in the bottom 21 of cover 14 is sized to be slightly larger than socket 26 for providing access for male connector 16 to socket 26. Opening 40 has a central axis 50 which generally coincides with the central axis 32 of socket 26 (FIG. 1) when insert 12 is assembled with cover 14. Cover 14 has a curved generally circular tip 14*b* that matches the curvature of the end 18*a* of the socket portion 18 of insert 12. As a result, groove 44 becomes curved near tip 14*b*. The bottom 21 of cover 14 includes two cantilevered beams 42. Each cantilevered beam 42 is defined by a rectangular recess 46 extending within the bottom wall of cover 14 and two narrow slots 47. When insert 12 is slid into groove 44, tabs 34 slightly deflect beams 42 downwardly before sliding past and becoming trapped in recesses 46 to lock insert 12 therein.

In one embodiment, cover 14 is 1.03 inches long, 0.562 inches wide and 0.31 inches tall. Opening 40 is 0.4 inches in diameter and concentric with central axis 50. Groove 44 is 0.026 inches high and has an entrance 52 that is 0.051 inches high. The width of groove 44 as seen in FIG. 6 is 0.496 inches. The wall thickness of cover 14 is typically about 0.06 inches. Recesses 46 are 0.106 inches wide and 0.071 inches long. Cantilevered beams 42 are 0.21 inches long and 0.066 inches wide. Slots 47 are 0.02 inches wide. Preferably, cover 14 is formed from a rigid plastic such as nylon but may be made of other suitable polymers and may be flexible.

Figure 7:
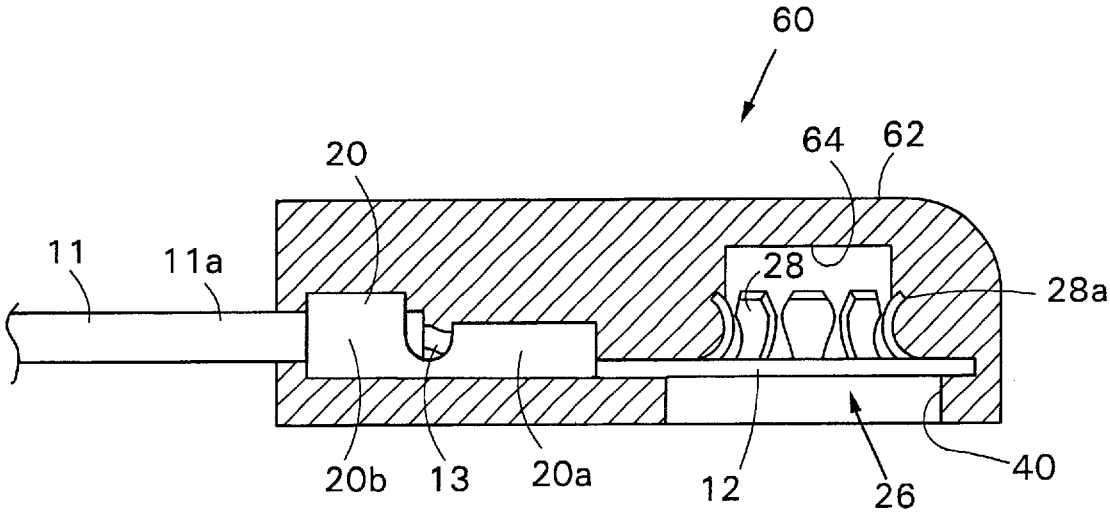
FIG. 7 is a side sectional view of another embodiment of the present invention connector terminal.

Referring to FIG. 7, connector 60 is another embodiment of the present invention. Connector 60 differs from connector 10 in that connector 60 includes a cover 62 that is molded around insert 12 and the end of cable 11. In such an embodiment, protruding tabs 34 (FIGS. 2 and 3) are not necessary and may be omitted as shown. Cover 62 includes circular recess 64 extending from opening 40 therein to allow the insertion of male connector 16. The tips 28*a* of contacts 28 may curve into the molded cover 62 as shown. Recess 64 extends above contacts 28 to provide space for male connector 16. Cover 62 may be made of a rigid as well as a flexible polymer. The contacts 28 are partially embedded within the wall of recess 64 so that deflection of contacts 28 also results in some deflection of material of the cover 62 abutting the contacts 28. As a result, the material of cover 62 may be selected to provide the desired deflection characteristics for contacts 28. In addition, the size or shape of recess 64 may be varied for acquiring particular deflection characteristics of contacts 28. Furthermore, the configuration of the recess 64 and the material of cover 62 may be employed to aid socket 26 in maintaining its proper shape and prevent damage to contacts 28 from excessive deflection.

Figure 8:
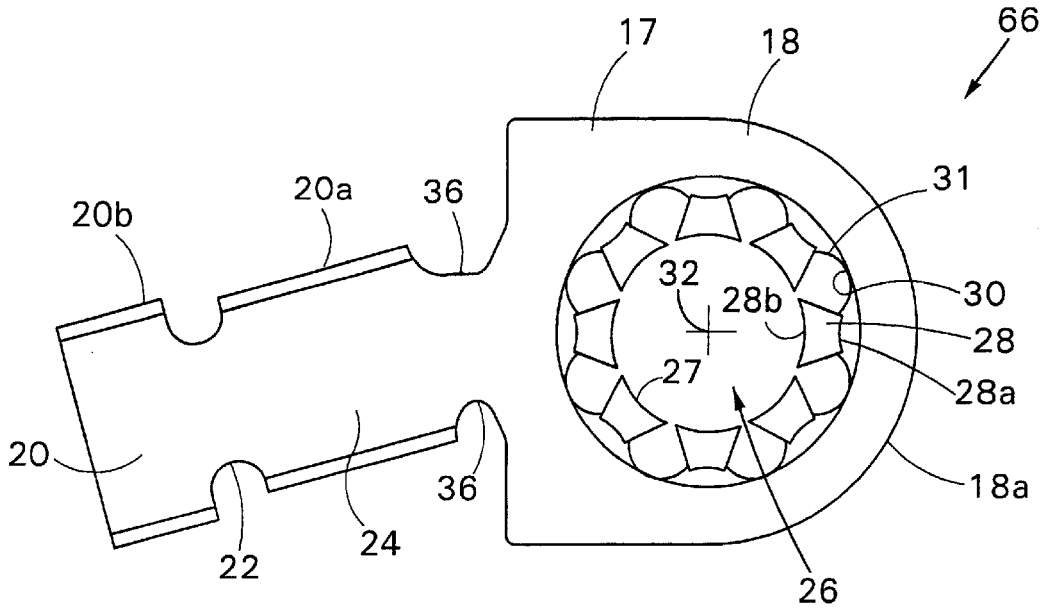
FIG. 8 is a top view of another insert for the present invention connector terminal.

FIG. 8 depicts an insert 66 which may be employed instead of insert 12. Insert 66 differs from insert 12 in that insert 66 has a securement portion 20 that extends at an angle relative to socket portion 18. In situations where a cover 62 is molded over insert 66, tabs 34 (FIGS. 2 and 3) may be omitted as shown. Insert 66 may be employed in locations where space surrounding the male connector 16 is limited or where the angled securement portion 20 positions the cable 11 in a particular desired orientation. The angle of the securement portion 20 may be varied to suit the situation at hand. In addition, securement portion 20 may be angled in the opposite direction to that shown.

Figure 9:
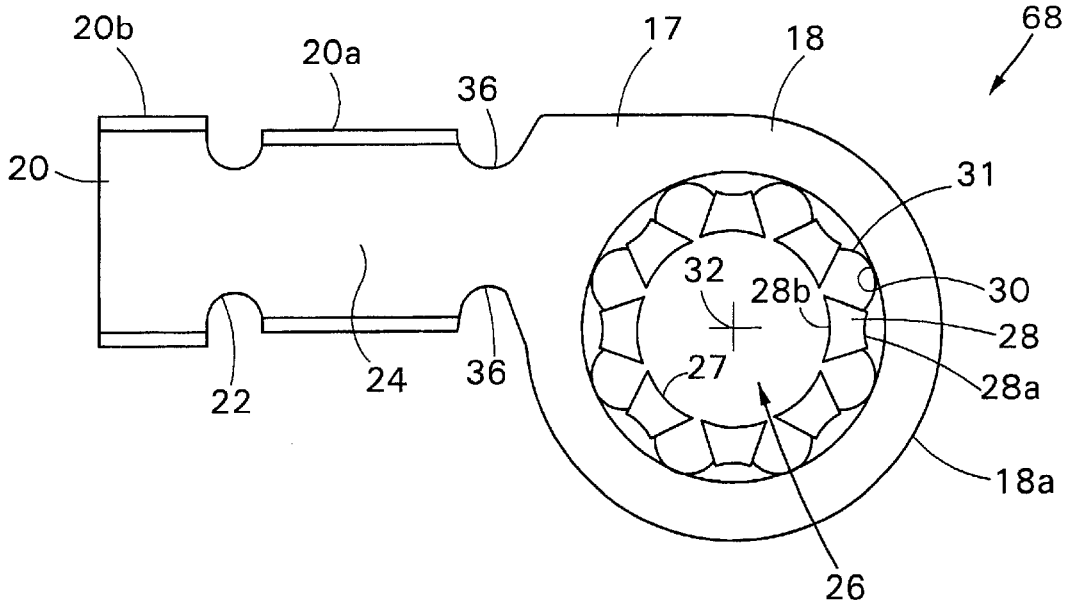
FIG. 9 is a top view of yet another insert.

Referring to FIG. 9, insert 68 is another insert which may be employed instead of insert 12. Insert 68 differs from insert 12 in that securement portion 20 is not aligned with the central axis 32 of socket 26 but instead extends longitudinally from one side of socket portion 18. Tabs 34 may be omitted as shown. In addition, one side of socket portion 18 may be curved as shown.

Figure 10:
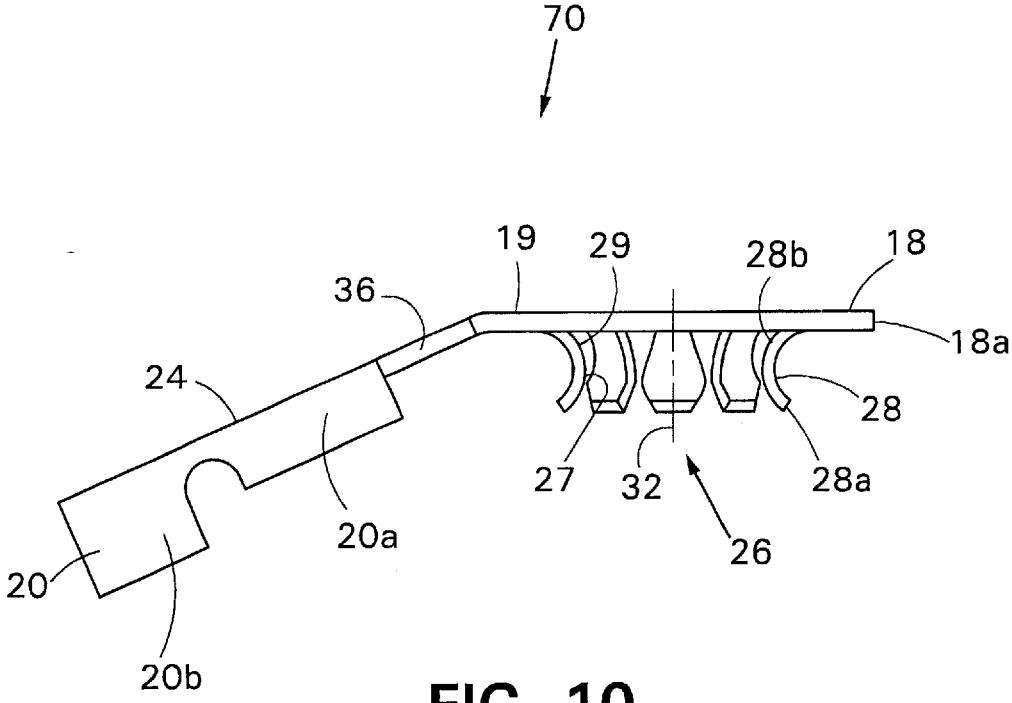
FIG. 10 is a side view of still another insert.

Referring to FIG. 10, insert 70 is yet another insert which may be employed instead of insert 12. Insert 70 differs from insert 12 in that securement portion 20 is bent at an angle relative to the plane of socket portion 18. Insert 70 may be used where it is desirable for the cable 11 to extend at a particular angle relative to the axis 32 of socket 26. The angle of securement portion 20 may be varied to suit the situation at hand. In addition, securement portion 20 may be bent in the opposite direction to that shown.

Figure 11:
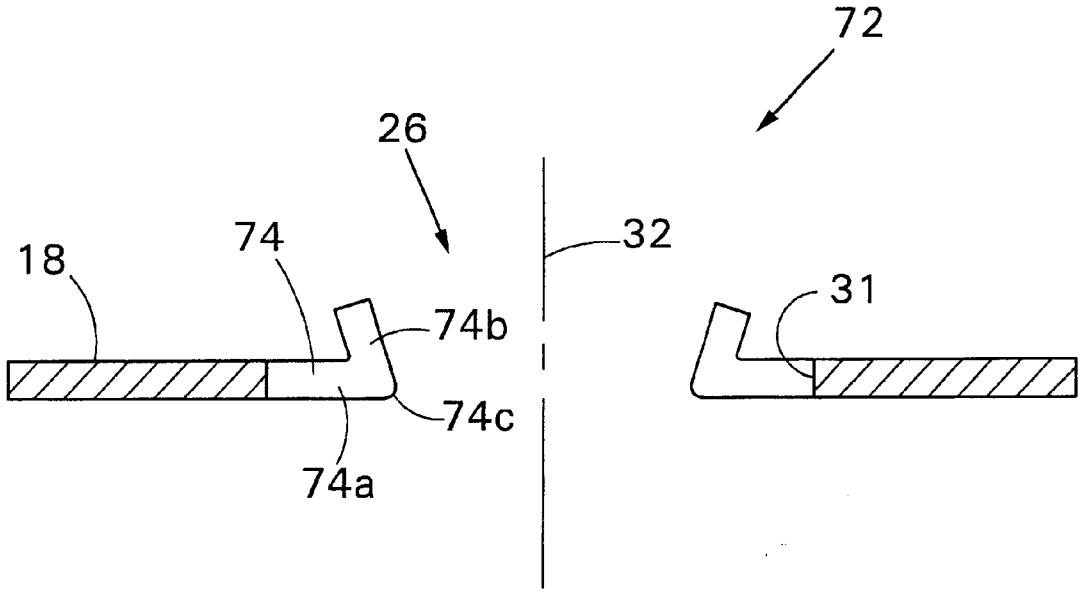
FIG. 11 is a schematic sectional view depicting a portion of the socket of yet another insert.

FIG. 11 depicts the contacts 74 of still another insert 72 of the present invention. The contacts 74 differ from the contacts 28 of insert 12 in that contacts 74 are not curved outwardly in a constant radius. Instead, each contact 74 has a straight portion 70*a* which extends inwardly toward central axis 32 along the same plane as socket portion 18, and a straight tip 74*b* which is bent at an angle to extend outwardly relative to axis 32. The outwardly bent tip 74*b* allows a male connector 16 to be inserted and removed from the socket 26 without the tips 74*b* digging into the post 16*a* of male connector 16. The bend 74*c* provides the contact surface for contacting male connector 16.

Figure 12:
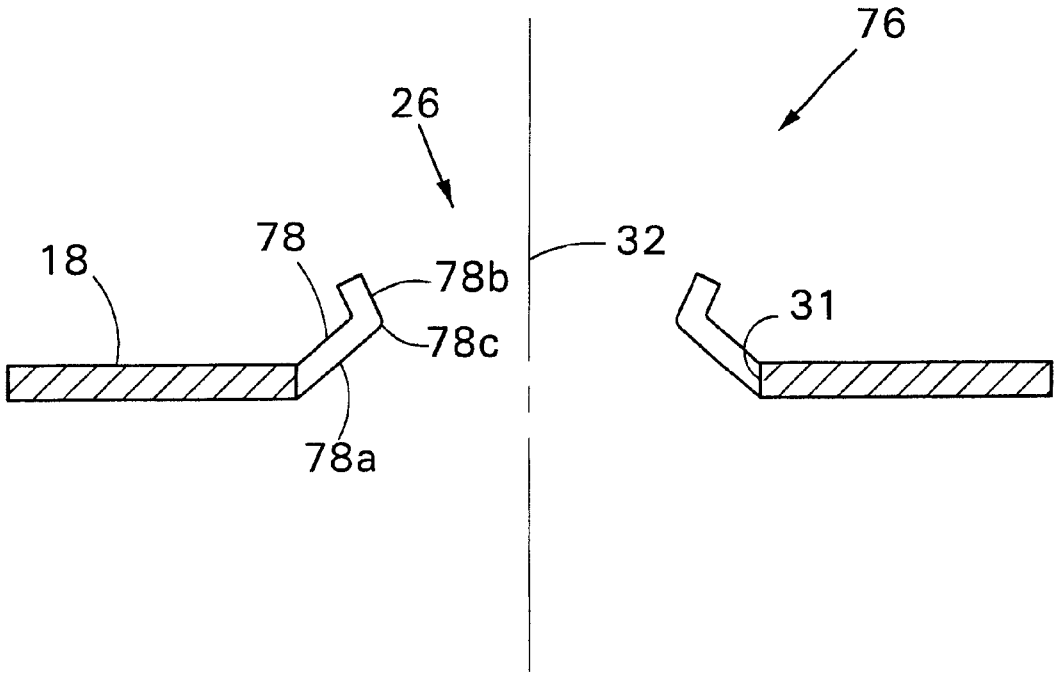
FIG. 12 is a schematic sectional view depicting a portion of the socket of still another insert.

FIG. 12 depicts the contacts 78 of another insert 76 of the present invention. Contacts 78 differ from contacts 74 of insert 72 in that contacts 78 have an inwardly angled straight portion 78*a* and a straight tip 78*b* which is bent at an angle to extend outwardly relative to axis. The bend 78*c* between portion 78*a* and tip 78*b* provides the contact surface for contacting male connector 16. The angles of portion 78*a* and tip 78*b* may be varied to provide the desired engagement and deflection characteristics, depending upon the situation at hand.

While this invention has been particularly shown and described with references to preferred embodiments thereof, it will be understood by those skilled in the art that various changes in form and details may be made therein without departing from the scope of the invention encompassed by the appended claims.

For example, although particular materials and dimensions have been described above, it is understood that variations in materials and dimensions may be made to suit the situation at hand. In addition, although the inserts have been described to be formed from sheet metal, alternatively, the inserts may be molded. Furthermore, various features described above may be combined or omitted. Also, the contacts 28 and/or crimping tabs 20*a*/20*b* may extend in an opposite direction relative to the covers 14/62 than that shown. The insert in the present invention preferably has eight contacts which are arranged in opposed pairs. Alternatively, the insert may have more than eight or fewer than eight contacts and the contacts do not need to be in opposed pairs. Also, contact regions 27 of the contacts do not have to be laterally curved. Although the present invention preferably has a securement portion 20 with crimping tabs, alternatively, the crimping tabs may be omitted and the conductor 13 of cable 11 instead soldered to the base 17 of the insert. It is understood that connectors 10 and 60 may mate with male connectors other than connector 16. Finally, although connectors 10 and 60 have been described for mating with a male connector soldered to automotive glass, it is understood that the connectors of the present invention may be used in a wide variety of applications including non-automotive and non-glass situations.

What is claimed is:

1. A connector terminal formed of sheet metal comprising:

a base with an opening extending therethrough, the opening being surrounded by an inner border of the base; and a socket comprising a series of resilient contacts extending away from the base, the contacts extending from said border and having opposed surfaces which are spaced apart from each other and positioned to define the socket, each of the contacts having feet which extend from said border, and contact regions for contacting a male terminal, each of the feet being narrower than the contact regions and configured to provide easier deflection, the sheet metal forming the connector terminal having a uniform thickness.

2. The connector terminal of claim 1 in which the base is generally planar.

3. The connector terminal of claim 2 in which the contacts have tips that extend in an outwardly direction.

4. The connector terminal of claim 3 in which the socket has eight contacts.

5. The connector terminal of claim 4 in which the socket is generally circular.

6. The connector terminal of claim 5 in which the socket has an axis which is perpendicular relative to the base, the contacts being equidistantly positioned about the axis and evenly spaced apart from each other.

7. The connector terminal of claim 1 in which the contacts curve outwardly.

8. The connector terminal of claim 7 in which the contacts have a constant radius.

9. The connector terminal of claim 1 further comprising a securement portion including crimping tabs extending from the base for crimping to a conductor.

10. The connector terminal of claim 1 further comprising a polymeric cover housing the base.

11. The connector terminal of claim 1 in which each contact has a width that is angled to become wider at the contact regions.

12. A method of making an electrical connection comprising:

providing a female connector terminal formed from sheet metal comprising a base having an opening extending therethrough, the opening being surrounded by an inner border of the base, a series of resilient contacts extending away from the base to form a socket, the contacts extending from said border and having opposed surfaces which are spaced apart from each other and positioned to define the socket, each of the contacts having feet which extend from said border, and contact regions for contacting a male terminal, each of the feet being narrower than the contact regions and configured to provide easier deflection, the sheet metal forming the connector terminal having a uniform thickness; and inserting the mating male terminal into the socket for obtaining electrical communication between the male and female terminals.

13. The method of claim 12 further comprising providing the female terminal with a generally planar base.

14. The method of claim 13 further comprising providing the contacts of the female terminal with tips that extend in an outwardly direction.

15. The method of claim 14 further comprising extending 8 contacts from said border of the female terminal.

16. The method of claim 15 further comprising the step of positioning the contacts of the female terminal in a manner so that the socket is generally circular.

17. The method of claim 16 in which the socket of the female terminal has an axis which is perpendicular to the base, the method further comprising positioning the contacts equidistantly about the axis and evenly spaced apart from each other.

18. The method of claim 12 further comprising curving the contacts of the female terminal outwardly.

19. The method of claim 18 further comprising forming the contacts of the female terminal with a constant radius.

20. The method of claim 12 further comprising providing the female terminal with a securement portion including crimping tabs for crimping to a conductor.

21. The method of claim 12 further comprising housing the base within a polymeric cover.

22. The method of claim 12 in which each contact of the female terminal has a width, the method further comprising angling the width to become wider at the contact regions.

23. A method of forming a connector terminal from sheet metal comprising the steps of:

providing a base having an opening extending therethrough, the opening being surrounded by an inner border of the base; and extending a series of resilient contacts away from the base to form a socket, the contacts extending from said border and having opposed surfaces which are spaced apart from each other and positioned to define the socket, each of the contacts having feet which extend from said border, and contact regions for contacting a male terminal, each of the feet being narrower than the contact regions and configured to provide easier deflection, the sheet metal forming the connector terminal having a uniform thickness.

24. The method of claim 23 further comprising providing a generally planar base.

25. The method of claim 24 further comprising providing the contacts with tips that extend in an outwardly direction.

26. The method of claim 25 further comprising extending 8 contacts from said border of the female terminal.

27. The method of claim 26 further comprising the step of positioning the contacts in a manner so that the socket is generally circular.

28. The method of claim 27 in which the socket has an axis which is perpendicular to the base, the method further comprising positioning the contacts equidistantly about the axis and evenly spaced apart from each other.

29. The method of claim 23 further comprising curving the contacts outwardly.

30. The method of claim 29 further comprising forming the contacts with a constant radius.

31. The method of claim 23 further comprising providing a securement portion including crimping tabs for crimping to a conductor.

32. The method of claim 23 further comprising housing the base within a polymeric cover.

33. The method of claim 23 in which each contact of the female terminal has a width, the method further comprising angling the width to become wider at the contact regions.

* * * * *